US007886488B2

(12) United States Patent
Payne, Jr. et al.

(10) Patent No.: US 7,886,488 B2
(45) Date of Patent: Feb. 15, 2011

(54) ACOUSTICAL ISOLATION FLOOR UNDERLAYMENT SYSTEM

(75) Inventors: Stephen W. Payne, Jr., Wildwood, IL (US); Kurt J. Goodfriend, Oak Park, IL (US)

(73) Assignee: United States Gypsum Company, Chicago, IL (US)

( * ) Notice: Subject to any disclaimer, the term of this patent is extended or adjusted under 35 U.S.C. 154(b) by 321 days.

(21) Appl. No.: 11/455,365

(22) Filed: Jun. 19, 2006

(65) Prior Publication Data

US 2007/0289238 A1 Dec. 20, 2007

(51) Int. Cl.
*E04B 1/82* (2006.01)

(52) U.S. Cl. ..... 52/144; 52/480; 52/403.1

(58) Field of Classification Search ..... 52/144, 52/145, 403.1, 408, 414, 480; 472/92, 90; 181/285, 286, 290, 294
See application file for complete search history.

(56) References Cited

U.S. PATENT DOCUMENTS 2,174,581 A * 10/1939 Hoge ..... 52/338
3,095,943 A * 7/1963 Kemp ..... 181/292
3,166,149 A * 1/1965 Hulse et al. ..... 181/292
3,229,785 A * 1/1966 Pottash ..... 181/290
3,666,606 A 5/1972 Stokes
3,712,846 A * 1/1973 Daniels et al. ..... 428/141
3,770,560 A * 11/1973 Elder et al. ..... 428/138
4,084,367 A * 4/1978 Saylor et al. ..... 428/113
4,130,175 A * 12/1978 Hehmann ..... 181/290
4,205,110 A * 5/1980 Jean ..... 428/213
4,235,303 A * 11/1980 Dhoore et al. ..... 181/214
4,294,329 A * 10/1981 Rose et al. ..... 181/222
4,313,524 A * 2/1982 Rose ..... 181/291
4,318,453 A * 3/1982 Rose et al. ..... 181/292
4,340,129 A * 7/1982 Salyers ..... 181/200
4,379,191 A * 4/1983 Beggs et al. ..... 428/118
4,384,020 A * 5/1983 Beggs et al. ..... 428/138
4,418,108 A * 11/1983 Lin ..... 428/139
4,421,811 A * 12/1983 Rose et al. ..... 428/116
4,433,021 A * 2/1984 Riel ..... 428/116
4,504,346 A * 3/1985 Newsam ..... 156/242
4,522,863 A * 6/1985 Keck et al. ..... 428/196
4,539,244 A * 9/1985 Beggs et al. ..... 428/116
4,541,879 A * 9/1985 Riel ..... 156/64
4,671,841 A * 6/1987 Stephens ..... 156/292

(Continued)

OTHER PUBLICATIONS

IG161915-04 - LEVELROCK Brand Sound Reduction Mat SRM-25, 2004, United States Gypsum Company, Industrial Division (USG).

*Primary Examiner*—Brian E Glessner
*Assistant Examiner*—James J Buckle, Jr.
(74) *Attorney, Agent, or Firm*—Greer, Burns & Crain, Ltd.; Philip T. Petti, Esq.; Pradip K. Sahu, Esq.

(57) ABSTRACT

An acoustic isolation medium configured for placement between a subfloor and a finished floor with a poured underlayment, includes a first layer being a sound reduction mat disposed upon the subfloor, a second layer placed upon the first layer and being one of a sheet of fibrous material and a web of limp mass material with a high internal damping coefficient, and a third layer placed upon the second layer and being the other of a sheet of the fibrous material and a web of the limp mass material.

17 Claims, 2 Drawing Sheets

U.S. PATENT DOCUMENTS 4,681,786 A 7/1987 Brown
4,685,259 A * 8/1987 Eberhart et al. ..... 52/144
4,698,249 A 10/1987 Brown
4,741,945 A * 5/1988 Brant et al. ..... 428/158
4,849,276 A * 7/1989 Bendig et al. ..... 428/117
4,909,003 A * 3/1990 Hennigan ..... 52/144
4,990,391 A * 2/1991 Veta et al. ..... 428/116
5,068,001 A * 11/1991 Haussling ..... 156/222
5,106,668 A * 4/1992 Turner et al. ..... 428/116
5,172,527 A 12/1992 Ault
5,187,905 A * 2/1993 Pourtau et al. ..... 52/144
5,205,091 A 4/1993 Brown
5,414,232 A * 5/1995 Wilson ..... 181/292
5,445,861 A * 8/1995 Newton et al. ..... 428/116
5,501,895 A 3/1996 Finley et al.
5,543,198 A * 8/1996 Wilson ..... 428/116
5,578,363 A 11/1996 Finley et al.
5,584,950 A * 12/1996 Gaffigan ..... 156/71
5,632,844 A * 5/1997 Pate et al. ..... 156/290
5,867,957 A * 2/1999 Holtrop ..... 52/403.1
5,968,630 A * 10/1999 Foster ..... 428/77
6,065,717 A * 5/2000 Boock ..... 244/1 N
6,077,613 A * 6/2000 Gaffigan ..... 428/442
6,167,668 B1 1/2001 Fine et al.
6,176,964 B1 * 1/2001 Parente et al. ..... 156/306.9
6,179,086 B1 * 1/2001 Bansemir et al. ..... 181/292
6,179,371 B1 * 1/2001 Miller ..... 296/191
6,319,579 B1 * 11/2001 Strandgaard ..... 428/45
6,369,120 B1 4/2002 Chaudhary et al.
6,371,242 B1 * 4/2002 Wilson et al. ..... 181/292
6,435,784 B2 * 8/2002 De Mattia et al. ..... 409/132
6,440,521 B1 * 8/2002 Moore ..... 428/73
6,569,509 B1 * 5/2003 Alts ..... 428/73
6,576,577 B1 6/2003 Garner
6,599,599 B1 * 7/2003 Buckwater et al. ..... 428/40.1
6,620,487 B1 * 9/2003 Tonyan et al. ..... 428/192
6,676,199 B2 * 1/2004 Buisson et al. ..... 296/193.07
6,830,796 B2 * 12/2004 Murray et al. ..... 428/73
6,986,229 B2 1/2006 Collison et al.
7,226,656 B2 * 6/2007 Coates et al. ..... 428/221
7,311,957 B2 * 12/2007 Bargo, II ..... 428/74
2003/0219582 A1 11/2003 Ramesh et al.
2005/0089678 A1 * 4/2005 Mead ..... 428/323
2007/0000198 A1 * 1/2007 Payne et al. ..... 52/414

* cited by examiner

ACOUSTICAL ISOLATION FLOOR UNDERLAYMENT SYSTEM

BACKGROUND OF THE INVENTION

The present invention relates to flooring systems designed to reduce airborne and impact sound transmission, and more specifically relates to an improved flooring system which improves acoustical isolation while having a relatively space-conserving profile to enhance compliance with existing building design parameters. Conventional flooring systems include a subfloor of poured concrete or plywood. Various underlayments located between the subfloor and the finished floor (typically ceramic tile, vinyl tile or hardwood) have been used to reduce sound transmission.

Sound rated or floating floor systems are known in the prior art for acoustically isolating a room beneath a floor on which impacts may occur, such as pedestrian footfalls, sports activities, dropping of toys, or scraping caused by moving furniture. Impact noise generation can generally be reduced by using thick carpeting, but where concrete, ceramic tile, sheet vinyl, or hardwood finishes are to be used a sound rated floor may be particularly desirable. The transmission of impact noise to the area below can be reduced by resiliently supporting the floor away from the floor substructure, which typically transmits the noise into the area below. If the floor surface receiving the impact is isolated from the substructure, then the impact sound transmission will be greatly reduced. Likewise, if the ceiling below is isolated from the substructure, the impact sound will be restricted from traveling into the area below.

Sound rated floors are typically evaluated by ASTM Standard #492 and are rated as to impact insulation class (IIC). The greater the IIC rating, the less impact noise will be transmitted to the area below. Floors may also be rated as to Sound Transmission Class (STC) per ASTM E90. The greater the STC rating, the less airborne sound will be transmitted to the area below. Sound rated floors typically are specified to have an IIC rating of not less than 50 and an STC rating of not less than 50. Even though an IIC rating of 50 meets many building codes, experience has shown that in luxury condominium applications even floor-ceiling systems having an IIC of rating 56-57 may not be acceptable because some impact noise is still audible.

In addition to having an adequate STC and IIC rating, an acceptable sound rated floor must also have a relatively low profile. Low profile is important to maintain minimum transition height between a finished sound rated floor and adjacent areas, such as carpeted floors, which ordinarily do not need the sound rated construction. Low profile is also important for maintaining door threshold and ceiling height dimensions, restraining construction costs, and maintaining other architectural parameters.

Also, a sound rated floor must exhibit enough vertical stiffness to reduce cracking, creaking, and deflection of the finished covering. At the same time, the sound rated floor must be resilient enough to isolate the impact noise from the area to be protected below. Thus, designers of acoustic flooring must strike a balance between vibration dampening and structural integrity of the floor.

Two isolation media currently used and also approved by the Ceramic Tile Institute for sound rated tile floors are (i) 0.4 inch ENKASONIC® brand matting (nylon and carbon black spinerette extruded 630 g/sq. meter) manufactured by Colbond Inc. of Enka, N.C. and (ii) 0.25 inch Dow ETHAFOAM™ (polyethylene foam 2.7 pcf) manufactured by Dow Chemical Co., Midland Mich. While both of these systems are statically relatively soft and provide some degree of resiliency for impact insulation, the added effect of air stiffness in the 0.25 and 0.40 inch thick media makes the system very stiff dynamically and limits the amount of impact insulation. Because the systems are statically soft, they do not provide a high degree of support for the finished floor, and a relatively thick (7/16 inch) glass mesh mortar board, such as a product called Wonderboard, is used on top of the media to provide rigidity for preventing grout, tiles, and other finished flooring from cracking. Alternatively, a relatively thick (1¼ inch) reinforced mortar bed must be installed on top of the resilient mat.

Another known isolation system includes the installation of pads or mounts placed on a subfloor, wooden sleepers are then laid over the isolation pads or mounts, and a plywood deck is fastened to the sleepers to form a secondary subfloor. Often, glass fiber insulation is placed in the cavity defined between the sleepers. A poured or sheet-type underlayment material is then applied to the secondary subfloor. While acoustically effective in reducing sound transmissions, this system adds as much as 6 inches to the thickness of a floor. This thickness is undesirable in most commercial and multi-family residential buildings.

Other known acoustic flooring materials include a poured settable underlayment sold under the mark LEVELROCK™ by United States Gypsum Company of Chicago, Ill. (USG). LEVELROCK underlayment is a mixture of Plaster of Paris, Portland Cement and Crystalline Silica. LEVELROCK underlayments have been used with sound reduction mats (SRM) located between the underlayment and the subfloor. Such mats are made of polymeric material and are typically a matrix of hollow cylindrical shapes held together by a thin mesh. Another material used to dampen sound transmission is Sound Reduction Board (SRB) sold by USG of Chicago, Ill., also under the mark LEVELROCK™. SRB is a mixture of man-made vitreous fiber and minerals, including slag wool fiber, expanded Perlite, starch, cellulose, Kaolin and crystalline silica.

However, known acoustic flooring systems have been unable to consistently achieve IIC values greater than 50 and in the desired range of 55-60. Accordingly, there is a need for an improved sound reduction flooring which addresses the above-identified design parameters.

BRIEF SUMMARY OF THE INVENTION

The above-listed objects are met or exceeded by the present acoustical isolation floor underlayment system, which features enhanced sound reduction properties, maintenance of acceptable floor structural integrity and maintains a relatively low profile. One of the ways in which these goals are achieved is by providing a composite underlayment of a plurality of layers of materials, each layer having discontinuous acoustic properties, which reduce the amount of sound energy transmitted between the layers, and ultimately, through the floor. In addition, the arrangement and selection of the materials distributes impact loading to dissipate compression of relatively resilient materials.

More specifically, the present invention provides an acoustic isolation medium configured for placement between a subfloor and a finished floor with a poured underlayment, includes a first layer being a sound reduction mat disposed upon the subfloor, a second layer placed upon the first layer and being one of a sheet of fibrous material and a web of high-density limp mass material with a high internal damping coefficient, and a third layer placed upon the second layer and being the other of a sheet of the fibrous material and a web of the high-density limp mass material.

In another embodiment, an acoustic flooring isolation underlayment system is configured for placement between a subfloor and a finished floor, and includes a first layer being a sound reduction mat disposed upon the subfloor. A second layer is placed upon the first layer, being made of a material discontinuous from the first layer, being homogeneous and providing cushioning and sound absorption. A third layer is placed upon the second layer, being made of a material which is discontinuous from the second layer, is homogeneous and is compression resistant.

DETAILED DESCRIPTION OF THE INVENTION

Figure 1:
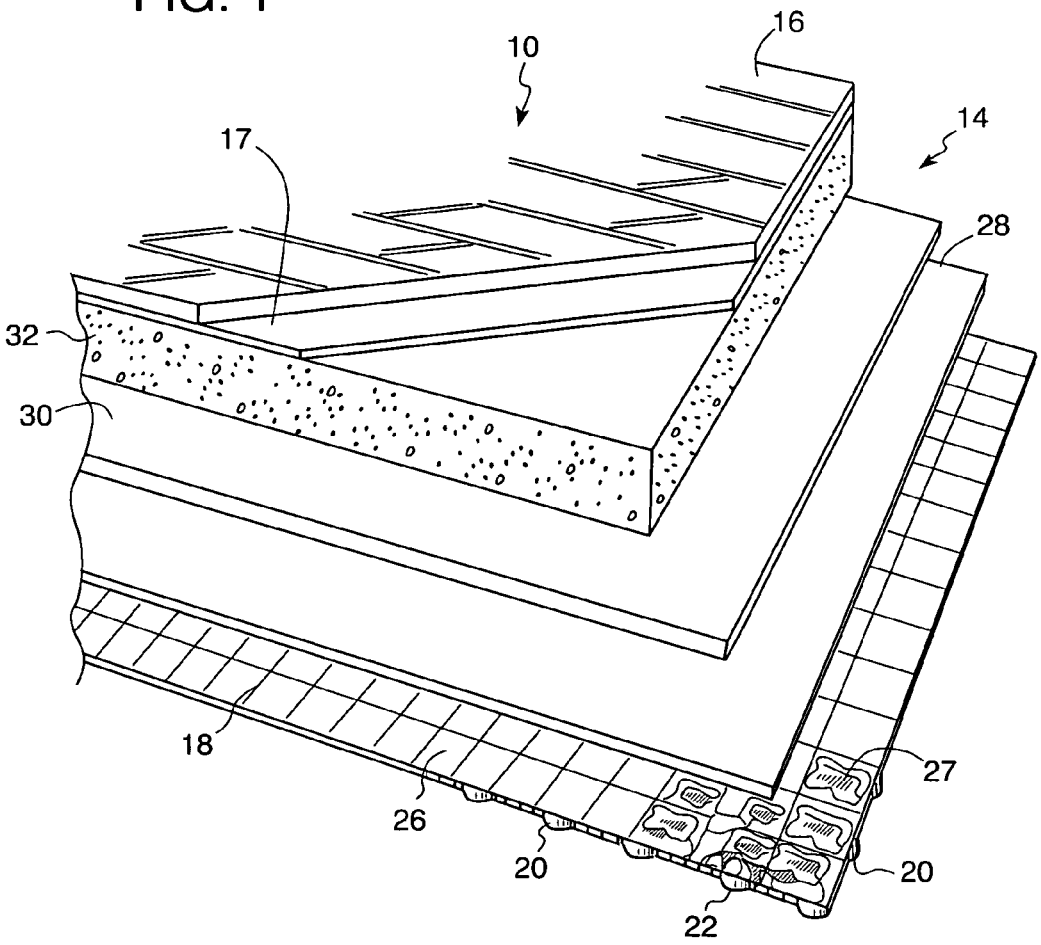
FIG. 1 is a fragmentary top perspective view of a floor including a preferred embodiment of the present acoustic underlayment system.
Figure 2:
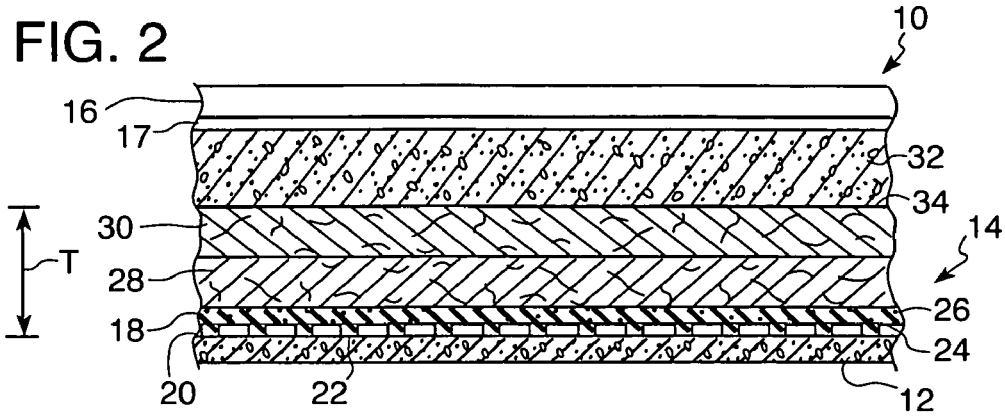
FIG. 2 is a schematic vertical section of the underlayment system of FIG. 1.

Referring now to FIGS. 1 and 2, the present flooring system is generally designated 10, and is used in a construction having a subfloor 12, which is shown schematically and typically includes poured concrete or at least one layer of plywood as is known in the art. While only the above two alternatives are disclosed, it is contemplated that any conventional subfloor material will be suitable for use with the present flooring system 10. As is known in the art, the subfloor is supported by joists (not shown) typically made of wood, steel or concrete.

The present flooring system 10 includes an acoustical isolation floor underlayment, generally designated 14 which is disposed between the subfloor 12 and a finished floor 16 which is typically ceramic tile, vinyl tile, hardwood or other hard materials other than carpeting. An adhesive layer 17 such as mortar, mastic or chemical adhesive secures the finished floor 16 to the underlayment 14.

A first layer 18 which is disposed upon the subfloor 12 is a sound reduction mat (SRM) made of a polymeric material and configured as a plurality of open hollow, cylinders 20 disposed in an array of spaced, preferably parallel rows with lower ends 22 facing the subfloor 12. The cylinders 20 are held together at opposite ends 24 by a polymeric lattice 26. Three functions are served by the SRM layer 18: it provides a water or vapor barrier, the cylinders 20 cushion the floor system 10 and absorb impact forces, and it provides one level of discontinuity of material and substantially reduced contact area, which is an important factor in reducing sound transmissions through the flooring system 10.

A preferred SRM is sold by USG under LEVELROCK™ SRM-25 sound reduction mat, having a polyethylene core forming the cylinders 22 and a polypropylene fabric forming the lattice 26. The lattice 26 also preferably has a textured upper surface 27 as shown fragmentarily in FIG. 1. While the above-described construction is considered preferred, it is also contemplated that other materials offering a cushioned vapor barrier and a discontinuous material may be used. One alternative providing less desirable acoustical properties is the above-described non-woven nylon fiber or coated wire matting such as ENKASONIC #9110 matting, manufactured by Coldbond Inc., Enka, N.C., used above a separate water impervious mat.

A second layer of the acoustical isolation underlayment 14 is generally designated 28 and is preferably a sheet of fibrous material of homogeneous thickness and construction. In the present application, "homogeneous" shall refer to the sheet having a substantially uniform height or thickness, and being substantially uniform across its area to provide consistent shock and sound absorption. Preferably, the second layer 28 is a sheet of fiberglass having a height or thickness of approximately ¼ inch and a density of approximately 3 pounds per cubic foot (pcf) (48.06 kg/cu.m). The second layer 28 is loosely disposed above the SRM 18, preferably without adhesive or other fasteners. Another important feature of the second layer 28 is that it is discontinuous with the SRM 18. As such, sound energy being transmitted through the floor system 10 is dampened and/or dissipated as it progresses through the layers 18, 28.

A third layer of the acoustical isolation underlayment 14 is generally designated 30 and is preferably a high-density limp mass material with a high internal damping coefficient. In the present application, "high density" refers to densities in the preferred range of 22-72 pcf; however densities beginning at 10 pcf and exceeding 72 pcf are contemplated as being suitable. For the purposes of the present application, "high internal damping coefficient" refers to a coefficient of 0.01 or greater at 1000 Hz. Such material is discontinuous with the second layer 28. In addition, the material used in the layer 30 prevents compression of the fibrous second layer 28.

Preferably, the third layer 30 is provided as sheets of Sound Reduction Board having a composition of at least 30% by weight slag wool fiber; no more than 40% by weight expanded Perlite, less than 15% by weight starch, at least 5% by weight cellulose and, less than 10% by weight Kaolin and less than 5% by weight crystalline silica. The ingredients are mixed, formed into slurry, formed into sheets and dried. A suitable type of such SRB is sold by USG under the LEVELROCK™ SRB brand, however equivalent types of SRB are commercially available. The SRB 30 is preferably laid upon the second layer 28 without adhesive or fasteners.

Figure 3:
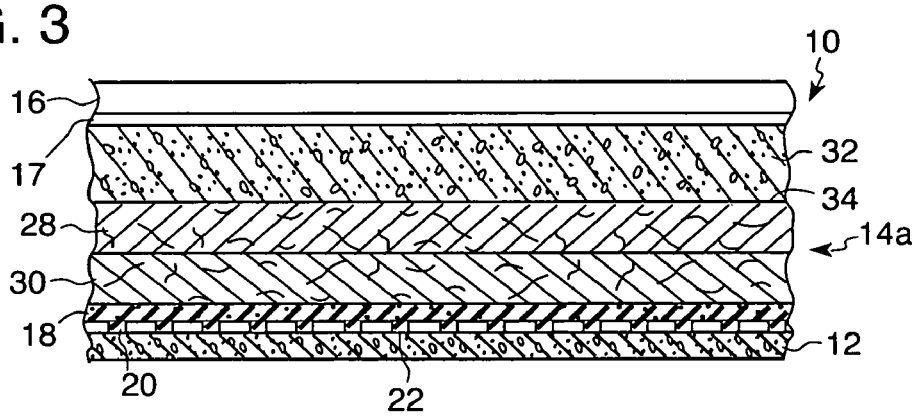
FIG. 3 is a schematic vertical section of an alternate embodiment of the underlayment system of FIG. 1.

Referring now to FIG. 3, an alternate sound reduction underlayment is generally designated 14*a*, and components shared with the underlayment 14 are designated with identical reference numbers. While it is preferred in the underlayment 14 that the fibrous layer 28 is below the SRB layer 30, in the underlayment 14*a* the disposition of these layers is reversed, with the SRB located directly above the SRM 18.

Figure 4:
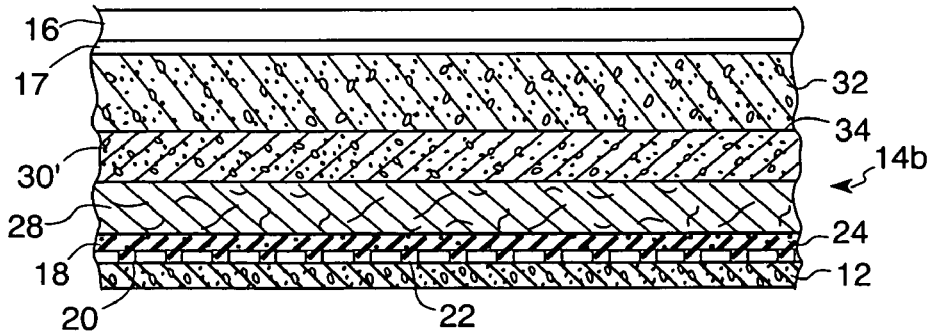
FIG. 4 is a schematic vertical section of a second alternate embodiment of the underlayment system of FIG. 1.

Referring now to FIG. 4, another alternate embodiment of the sound reduction underlayment 14 is generally designated 14*b*, and components shared with the underlayments 14, 14*a* are designated with identical reference numbers. In the underlayment 14*b*, an alternative material to the SRB in the third layer, designated 30' is a cementitious or cement board such as DUROCK® brand cement underlayment board manufactured by USG. This board is formed pursuant to the process in U.S. Pat. No. 4,916,004, which is incorporated by reference. In summary, aggregated Portland Cement slurry is combined with polymer-coated glass fiber mesh encompassing front, back and edges.

As is the case with the SRB board, the DUROCK® brand cementitious board is preferably disposed above the fibrous layer 28, but it is also contemplated that the fibrous layer is located above the third layer 30'. It will also be understood that the DUROCK® brand cementitious board, when used as the third layer 30', is acoustically discontinuous with the fibrous layer 28 and the SRM layer 18, as is the SRB.

In situations where the DUROCK® brand cement board is unsuitable, it is also contemplated that the third layer 30, 30' may be provided in the form of a poured, settable high-density limp mass material having a high internal damping coefficient, such as DUROCK® brand formulation supplied by USG. An alternative material to DUROCK® material is FIBEROCK® brand aquatough fiber reinforced sheathing panels manufactured by USG.

To address the low profile requirement discussed above, it is preferred that the combined assembled height or thickness "T" of the layers 18, 28 and 30 or 30' (FIG. 2) is less than or equal to one inch (2.5 cm). More specifically, the SRM 18 is preferably ¼ inch, the fibrous layer 28 is preferably ¼ inch, the SRB 30 is preferably ⅜ inch and the DUROCK® brand board 30' is preferably ½ inch. While these are commonly available thicknesses for these materials, it is contemplated that other dimensions are suitable for specific layers depending on the application and provided the overall "T" thickness does not exceed one inch.

Once the acoustic isolation underlayment 14 is assembled upon the subfloor 12, in the preferred embodiment a poured layer of settable underlayment 32 is applied to an upper surface 34 of the third layer 30. In the preferred embodiment, the poured underlayment 32 is USG LEVELROCK™ floor underlayment 2500, having a composition of at least 85% by weight Plaster of Paris ($CaSO4\frac{1}{2}H2O$), less than 10% by weight Portland Cement and less than 5% by weight crystalline silica. Upon setting of the underlayment 32, the finished floor 16 is applied as is well known in the art. In practice, due to the tendency of the settable underlayment to migrate into the fibrous layer 28, the underlayment 14 is considered preferable in many applications to that of the underlayment 14*a*.

In the present preferred application, regarding the underlayment 14, the IIC values were determined using a full scale test per ASTM E497 and were found to meet or exceed stated requirements of 55-60 IIC.

In either formulation, having the highly damped limp mass material adjacent to the rigid dense underlayment helps to dampen the initial acoustical vibration and thus improves the overall performance of the floor system.

Figure 5:
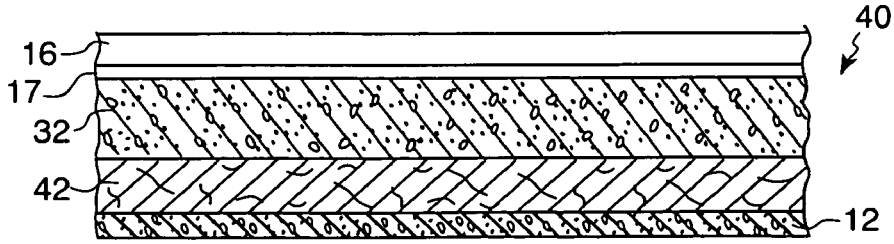
FIG. 5 is a schematic vertical section of a third alternate embodiment of the present underlayment system.

Referring now to FIG. 5, still another embodiment of the present floor system is generally designated 40. Components shared with the embodiments described above are designated with identical reference numbers. A layer of fibrous material 42, such as fiberglass as described above in relation to the layer 28, or other non-woven material is disposed upon the subfloor 12. As is the case with the layer 28, the fibrous material is homogeneous and is approximately ¼ inch high or thick. Next, the layer 42 is covered with a poured settable underlayment, 32 such as LEVELROCK™ underlayment discussed above. The finished floor 16 is then laid upon the LEVELROCK™ underlayment 32 as discussed above.

Thus, it will be seen that the present acoustical isolation underlayment system addresses the needs identified above, and provides a low profile system featuring several thin layers of discontinuous materials for absorbing sound energy between floors. Also, the structural integrity of the floor is maintained while also providing shock absorbing characteristics.

While particular embodiments of the present acoustical isolation floor underlayment system have been described herein, it will be appreciated by those skilled in the art that changes and modifications may be made thereto without departing from the invention in its broader aspects and as set forth in the following claims.

The invention claimed is:

1. An acoustic isolation medium configured for placement between a subfloor and a finished floor, comprising:

a first layer being a polymeric sound reduction mat disposed directly upon the subfloor, said sound reduction mat including a plurality of generally parallel, hollow cylinders, each of said cylinders including an upper end and a lower end, said lower end of each of said cylinders directly contacting the subfloor;

a second layer placed upon said upper end of each of said cylinders of said first layer and being one of a sheet of fibrous material and a web of limp mass material wherein said limp mass material is selected from the group consisting of sound reduction board and cementitious board, each board having a density of approximately 22-72 pcf; and a third layer placed upon said second layer and being the other of a sheet of the fibrous material and a web of the limp mass material, wherein a poured underlayment is placed upon said third layer, the isolation medium being disposed between the poured underlayment and the subfloor, wherein the finished floor is placed on the poured underlayment.

2. The isolation medium of claim 1 wherein said sheet of fibrous material is fiberglass.

3. The acoustic isolation medium of claim 2 wherein said fiberglass sheet is homogeneous.

4. The isolation medium of claim 1 wherein said sheet of fibrous material is approximately ¼ inch high and has a density of 3 pcf.

5. The acoustic isolation medium of claim 1 wherein said three layers combined have a height of less than or equal to one inch.

6. The acoustic isolation medium of claim 1 wherein each of said first, second and third layers is made of a material which is discontinuous from adjacent layers.

7. The acoustic isolation medium of claim 1 wherein, upon installation with said underlayment poured above said medium, forming a composite floor underlayment having an Impact Insulation Class in the approximate range of 55-60.

8. An acoustic flooring isolation underlayment system configured for placement between a subfloor and a finished floor with a poured underlayment, comprising:

a first layer being a polymeric sound reduction mat disposed directly upon the subfloor, said sound reduction mat including a plurality of generally parallel, hollow cylinders arranged in a matrix of generally parallel rows, each of said cylinders including a first end and a second end, said first end of each of said cylinders being joined together by a polymeric web and said second end of each of said cylinders directly contacting the subfloor;

a second layer placed upon said first end of each of said cylinders of said first layer, being made of a discontinuous material from said first layer, being homogeneous and providing cushioning and sound absorption; and a third layer placed upon said second layer, being made of a material which is discontinuous from said second layer and is homogeneous, wherein upon pouring the underlayment above the isolation system, a composite floor underlayment is formed having an Impact Insulation Class in the approximate range of 55-60.

9. The acoustic flooring system of claim 8 wherein said first, second and third layers have a combined height of less than or equal to one inch.

10. The acoustic flooring system of claim 8 further including a layer of poured settable material disposed upon said third layer.

11. The acoustic flooring system of claim 8 wherein said second and third layers are each a distinct one of a sheet of homogeneous fiberglass, a sound reduction board and a cementitious board.

12. An acoustic isolation flooring underlayment system configured for placement between a subfloor and a finished floor, comprising:

a first layer being a polymeric sound reduction mat including a plurality of generally parallel, hollow cylinders each of said cylinders having an upper end secured together by a polymeric material and a lower end disposed directly upon the subfloor;

a second layer placed upon said first layer and discontinuous from said first layer, said second layer being made of a homogeneous, fibrous material that provides cushioning and sound absorption;

a third layer placed upon said second layer, being made of a homogeneous material which is discontinuous from said second layer; and a layer of poured, settable material disposed upon said third layer.

13. The system of claim 12, wherein said second layer is made of fiberglass and said third layer is made of sound reduction board.

14. The acoustic isolation medium of claim 1 wherein said three layers combined have a height of less than or equal to one inch and wherein, upon installation with said underlayment poured above said medium, form a composite floor underlayment having an Impact Insulation Class in the approximate range of 55-60.

15. The system of claim 12, wherein said first, second and third layers have a combined height of less than or equal to one inch.

16. The isolation medium of claim 1, wherein said first layer is configured to be a barrier to at least one of water and vapor.

17. The system of claim 12, wherein said first layer is configured to be a barrier to at least one of water and vapor.

* * * * *